US008500509B2

(12) United States Patent
Orozco

(10) Patent No.: US 8,500,509 B2
(45) Date of Patent: Aug. 6, 2013

(54) ENTERTAINMENT DEVICE INCLUDING A REMOTE CONTROLLED MAGNETIC MINI-CRAFT

(76) Inventor: Juan Carlos Orozco, Leon (MX)

( * ) Notice: Subject to any disclaimer, the term of this patent is extended or adjusted under 35 U.S.C. 154(b) by 127 days.

(21) Appl. No.: 13/086,531

(22) Filed: Apr. 14, 2011

(65) Prior Publication Data

US 2011/0189920 A1 Aug. 4, 2011

Related U.S. Application Data

(63) Continuation-in-part of application No. 12/228,950, filed on Aug. 17, 2008, now abandoned.

(60) Provisional application No. 60/965,107, filed on Aug. 17, 2007.

(51) Int. Cl.
*A63H 33/26* (2006.01)

(52) U.S. Cl.
USPC ..... 446/131; 446/37; 446/154; 446/156; 446/161; 446/199; 446/232; 446/236; 446/267; 446/484; 446/129; 40/426; 40/409

(58) Field of Classification Search
USPC ..... 40/406, 426, 409; 446/133, 134, 446/136, 129, 267, 131, 236, 37–38, 153–156, 446/160–161, 255
See application file for complete search history.

(56) References Cited

U.S. PATENT DOCUMENTS 634,996 A * 10/1899 Platt ..... 446/42
693,327 A * 2/1902 Matteson et al. ..... 446/38
811,784 A * 2/1906 Matteson ..... 446/38
2,377,175 A * 5/1945 Peer ..... 307/11
3,124,898 A * 3/1964 Henrichsen ..... 446/38
3,144,730 A * 8/1964 Johnson ..... 446/153
3,239,956 A * 3/1966 Canonica, Jr. ..... 40/426
3,358,676 A * 12/1967 Frei et al. ..... 600/12
3,569,969 A 3/1971 Lemon
3,650,056 A * 3/1972 Walton ..... 40/409
4,382,245 A * 5/1983 Harrigan ..... 335/306
4,568,301 A * 2/1986 Hawley, Jr. ..... 446/134
4,578,044 A * 3/1986 Saitoh ..... 446/134
4,691,459 A * 9/1987 Butler ..... 40/406
4,874,346 A * 10/1989 Wachspress ..... 446/484
5,125,888 A 6/1992 Howard et al.
5,284,454 A * 2/1994 Randolph ..... 446/45
5,301,444 A * 4/1994 Horiuchi ..... 40/426
5,417,605 A * 5/1995 Chan ..... 446/136
5,463,826 A * 11/1995 Horiuchi ..... 40/426
5,483,764 A * 1/1996 Lin ..... 40/426
5,525,086 A * 6/1996 Gentile et al. ..... 446/41
5,603,994 A * 2/1997 Su ..... 428/11

(Continued)

*Primary Examiner* — Gene Kim
*Assistant Examiner* — Matthew B Stanczak
(74) *Attorney, Agent, or Firm* — Dennis R. Haszko

(57) ABSTRACT

The present document describes an entertainment device including one or more mini-crafts provided in a fluid medium within the sides of an electromagnetic frame. Each mini-craft includes a magnet and has a different cutoff frequency. Motion of the mini-crafts may be controlled by a user using a controller such as joystick, remote control etc. A processor computes, based on the multidirectional navigation signals received from the controller, electromagnetic signals for each coil in the electromagnetic frame. The electromagnetic signals are amplified and sent to the coils to generate superimposed rotating magnetic fields which cause the mini-crafts to rotate separately within the electromagnetic frame, each mini-craft following a distinct magnetic field with a frequency that is lower than its cutoff frequency.

20 Claims, 13 Drawing Sheets

U.S. PATENT DOCUMENTS 5,685,096 A * 11/1997 Horiuchi ..... 40/426
5,883,454 A * 3/1999 Hones et al. ..... 310/90.5
6,062,938 A * 5/2000 Meng-Suen ..... 446/134
6,131,318 A * 10/2000 Hsieh ..... 40/406
6,148,770 A * 11/2000 Lin ..... 119/253
6,332,282 B1 * 12/2001 Lin ..... 40/406
6,439,949 B1 8/2002 Lucas et al.
6,564,484 B1 * 5/2003 Ikenaga et al. ..... 40/426
6,608,540 B1 * 8/2003 Hones et al. ..... 310/90.5
6,665,964 B2 12/2003 Klotz
2003/0027483 A1 * 2/2003 Rosenberg ..... 446/129
2003/0163937 A1 9/2003 Klotz
2005/0052178 A1 3/2005 Ries
2005/0208867 A1 9/2005 Higashida
2006/0160459 A1 * 7/2006 Chien-Chih ..... 446/153

* cited by examiner

ENTERTAINMENT DEVICE INCLUDING A REMOTE CONTROLLED MAGNETIC MINI-CRAFT

CROSS-REFERENCE TO RELATED APPLICATIONS

This application is filed under 37 CFR 1.53(b) as a continuation-in-part application. This application claims priority under 35 USC §120 of U.S. patent application Ser. No. 12/228,950 filed on Aug. 17, 2008, the specification of which is hereby incorporated by reference in its entirety.

BACKGROUND (a) Field

The subject matter disclosed generally relates to an educational and entertainment device. More particularly the subject matter relates to a scientific toy including a fluid medium and a wirelessly controlled mini-craft within the fluid medium.

(b) Related Prior Art

Entertainment toys including animated magnetically activated devices and objects are known in the art. Most of the prior art devices of this type are magnetically activated marine objects such as a toy fish that includes a magnet which is freely suspended in a liquid medium contained in a vessel supported on a base or a panel, and a magnetic means is disposed below the supporting base.

In most of the prior art apparatus, the movements of the movable object or toy fish is limited, usually to either random vertical and horizontal movements or predefined pattern simulations of real fish for the purpose of ornamentation or decoration, and there is no provision for human interaction with the object that allows the object to be controlled at will by the user to maneuver it in any direction by interacting through a human machine interface, or autonomously following a program.

Furthermore, none of the prior art devices allows for independent control of more than one mini-craft in the fluid medium.

SUMMARY

According to an aspect, there is provided an entertainment device comprising:

a fluid medium;

an electromagnetic frame disposed adjacent to the fluid medium, said frame having a plurality of sides and an electromagnetic coil at each slide;

a mini-craft disposed within the sides of the frame, said mini-craft comprising a magnet;

a communication port adapted to receive multidirectional navigation signals from a controller;

a processor adapted to compute, based on the multidirectional navigation signals, electromagnetic signals for each coil in the electromagnetic frame; said electromagnetic signals cause the coils to generate rotating magnetic fields and gradients which cause the mini-craft to rotate within the fluid medium and move in the directions indicated by the navigation signals.

According to another aspect, there is provided a method for independently controlling the motion of multiple mini-crafts in a fluid medium magnetically, the mini-crafts having different cutoff frequencies, said method comprising:

classifying the mini-crafts in order of the magnitudes of their cutoff frequencies;

starting with the mini-craft having the highest cutoff frequency and ending with the mini-craft having the lowest cutoff frequency, applying for each mini-craft a superimposed rotating electromagnetic field at a frequency which is smaller than the cutoff frequency of the subject mini-craft and greater than the cutoff frequency which is just below it;

wherein a mini-craft which rotates at a rotating electromagnetic field with a certain frequency would not respond to an electromagnetic field with a lower frequency due to its inertia.

According to a further aspect, there is provided an entertainment device comprising:

a fluid medium;

an electromagnetic frame disposed adjacent to the fluid medium, said frame having a plurality of sides and an electromagnetic coil at each side;

a plurality of mini-crafts disposed within the sides of the frame, each mini-craft comprising a magnet and a different cutoff frequency;

a communication port adapted to receive multidirectional navigation signals from a controller; and a processor adapted to compute, based on the multidirectional navigation signals, electromagnetic signals for each coil in the electromagnetic frame; said electromagnetic signals cause the coils to generate superimposed rotating magnetic fields having different frequencies; wherein each mini-craft responds to only one magnetic field based on its cutoff frequency In an embodiment, the mini-craft maintains its position in the fluid medium when no electromagnetic force is applied thereon. The mini-craft may be substantially zero-buoyant with respect to the fluid contained in the fluid medium.

In another embodiment, the mini-craft is negative buoyant with respect to the fluid contained in the fluid medium, and the device comprises a propeller which flows the fluid upward continuously to compensate for the negative buoyancy of the mini-craft in the fluid. The device may further comprise a fluid pipe connected between a lower part of the fluid medium and an upper part of the fluid medium wherein the propeller is installed at one end of the feedback pipe.

In yet a further embodiment, the mini-craft has the shape of a propeller.

The multidirectional navigation signals may comprise motion commands to move the mini-craft along at least one of the X, Y, and Z axis.

The device may comprise multiple mini-crafts, each mini-craft having a different cutoff frequency, said cutoff frequency being dependent on the shape and size of the mini-craft and the magnet; said processor being adapted to compute superimposed electromagnetic signals to separately control each mini-craft based on its cutoff frequency.

The device may be battery powered and portable. In an embodiment, the mini-craft is free of any electric circuitry or component other than the magnet.

Features and advantages of the subject matter hereof will become more apparent in light of the following detailed description of selected embodiments, as illustrated in the accompanying figures. As will be realized, the subject matter disclosed and claimed is capable of modifications in various respects, all without departing from the scope of the claims. Accordingly, the drawings and the description are to be regarded as illustrative in nature, and not as restrictive and the full scope of the subject matter is set forth in the claims.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION OF THE PREFERRED EMBODIMENTS

Figure 1:
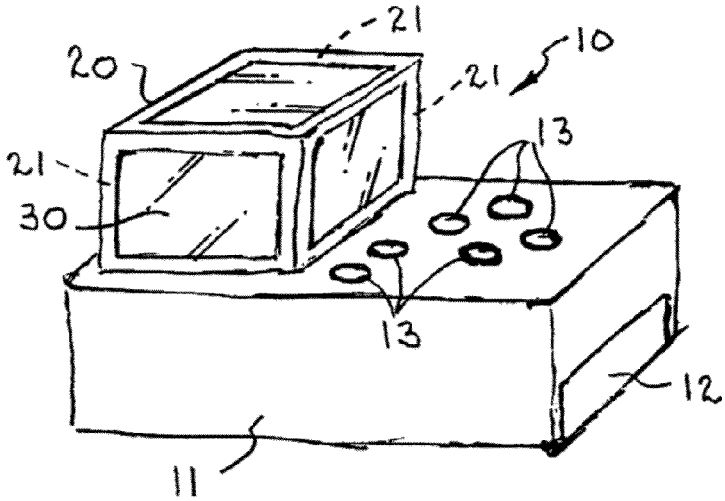
FIG. 1 is a perspective view of the remote controlled magnetic mini-craft apparatus in accordance with the present invention.

As used herein, the terms "craft" and "mini-craft" mean a vehicle designed for navigation in or on a fluid medium such as a liquid (for example, water or gel), or a gas (for example, air). In the following discussion, the present invention is shown and described, for purposes of example only, as being utilized in a liquid environment; however it should be understood that it may be utilized in any fluid medium which may be a liquid or gas (air) or a gel. The frame and one or more mini-crafts described hereinafter may be contained in a transparent container containing a liquid medium, or a large body of water, or the frame and mini-craft may be disposed in an open air environment. Therefore, specific details disclosed herein are not to be interpreted as limiting, but rather as a basis for the claims and as a representative basis for teaching one skilled in the art to employ the present invention in virtually any appropriately detailed system, structure or manner.

Referring to the drawings by numerals of reference, there is shown in FIGS. 1, 2, 3 and 4, an example of a preferred electromagnetic remote controlled mini-craft system 10. The system 10 includes a control means 11 which, in the illustrated example is a plastic case which also serves as a platform or base, and contains an electrical power source, such as a rechargeable battery pack 12, and has a control panel thereon with user control means, such as push buttons 13. Alternatively, the control means may be in the form of a controller such as a joystick or game controller.

Figure 2:
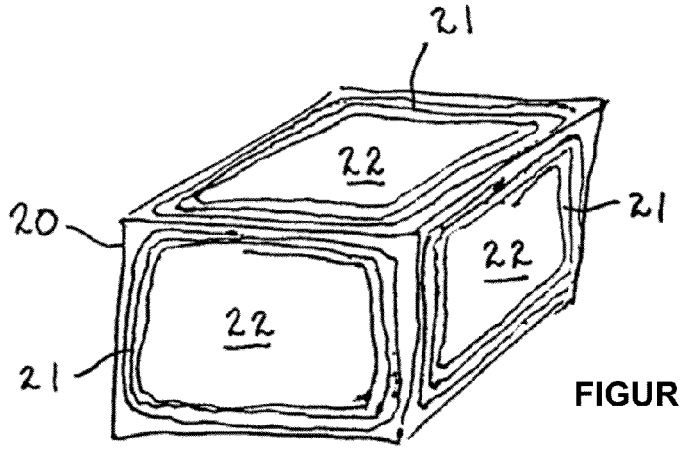
FIG. 2 is a perspective view of the electromagnetic frame, showing somewhat schematically, the electromagnet coils in the frame surrounding the openings in respective sides of the frame.

Referring additionally to FIG. 2, the system includes an electromagnetic frame 20, such as a generally rectangular frame having six sides (top, bottom, front, back left side and right side) with an electromagnetic coil 21 disposed in each of the six sides surrounding an opening 22. Both ends of each electromagnet coil 21 are connected in communication with the electrical power source 12, or battery pack through the push buttons 13 such that the coils may be energized by a user depressing one or more of the push buttons, or alternatively, by manipulating a controller such as a joystick or game controller. In a preferred embodiment, the electromagnets are of the type having a high magnetic permeability core; however coreless electromagnets may also be used. In the illustrated example, the generally rectangular electromagnetic frame 20 is shown supported on the platform or base 11; however, the frame may be freestanding and located remote from the control means. The size of the frame 20 can vary depending upon the strength and type of electromagnets used.

Figure 3:
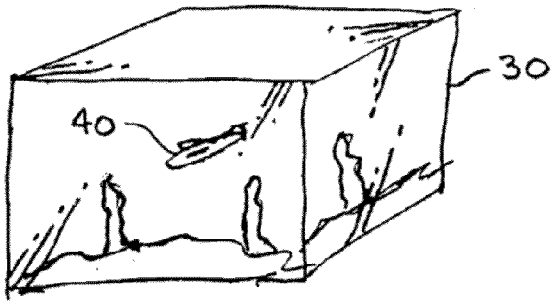
FIG. 3 is a perspective view of a transparent container that contains a liquid medium, and a mini-craft in the liquid medium.

Referring additionally to FIG. 3, in the illustrated example, a generally rectangular interchangeable transparent container 30 is removably received in the electromagnetic frame 20 such that its interior is visible through the openings 22 surrounded by the electromagnetic coils 21. The transparent interchangeable containers 30 are filled with one or more types of liquids. Preferably, the top face or lid of the container 30 is removable to allow a user to reach the inside the container. The interior of the interchangeable containers 30 may be provided with various different kinds of landscapes and/or including tunnels, obstacles and target points.

Alternatively, the electromagnetic frame 20 may be placed inside of the container 30, or the container may not be used at all, wherein the frame is freestanding and may be disposed in a tub, pool or large body of water such as a lake, or, in non-liquid applications the frame may be disposed in an open air environment.

It should be understood that the rectangular configuration of the container 30 and electromagnetic frame 20 in the illustrated embodiment is shown for purposes of example only, and that the container and electromagnetic frame may have a different closed geometric form and less or more faces or sides. The electromagnets 21 could also overlap, similar to the arrangements used on the stator of an AC motor, to improve uniformity of the rotating field.

Figure 4:
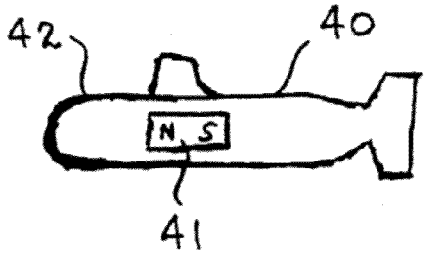
FIG. 4 is a side elevation view of an example of the mini-craft, showing magnet enclosed in the body of the craft.

A magnetic mini-craft 40 is placed inside of the transparent container 30, or inside of the electromagnetic frame 20 if it is disposed inside of the container, or if the container is not used and the frame is disposed in a tub, pool or large body of water such as a lake, or in a non-liquid open air environment. As best seen in FIG. 4, the magnetic mini-craft 40 includes a magnet 41 which may be fixed or free rotating inside of a plastic or foam body 42 that can have many forms or shapes, such as a submarine, boat, fish, airplane, blimp, helicopter, etc. Preferably, the magnetic mini-craft 40 is close to zero buoyant in the fluid environment (liquid or gas) in which it is designed to move.

In operation, of the exemplary illustrated embodiment, when one or more push buttons 13 are pressed by a user, the corresponding electromagnet 21 is energized and generates an electromagnetic field with a gradient towards it. This causes the magnet 41 contained inside the mini-craft 40 to move towards the activated electromagnet, and because there is an electromagnet in each side of the frame 20 (inside or outside of the container), the user can move and maneuver the mini-craft in any direction, for example, simulating the movement of a submarine. The mini-craft 40 can also be maneuvered by the user to navigate around and through the various different kinds of landscapes, tunnels, obstacles and target points.

Having described the basic components of the present invention in an exemplary embodiment, for purposes of example only, and its operation, the following discussion is directed toward several refinements and modifications that may be incorporated.

As described above, alternatively, the control means 11 for controlling the electromagnets 21 may comprise a "joystick" or "game controller" and may include a microcontroller and an amplifier or driver interface, rather than the control panel case with push buttons 13. The electromagnetic field gradients can be regulated in their intensity using a pulse wide modulated signal (PWM) incorporated into one or more controller microchips. The microprocessor or microchips may also include a digital signal processor (DSP) and high-speed counters to be used for pulse wide modulated signal (PWM) processing or digital analog converters (DAC) for use with an analog power amplifier.

The control means 11 or the frame 20 may also be provided with a communications port or wireless transceiver and direct or wirelessly connected with a desktop or laptop or microprocessor equipped with software programs and using keyboard or mouse operations to control the electromagnetic field gradients or pulse wide modulated signal (PWM) of each electromagnet, to manipulate the mini-craft(s) and provide various applications such as autonomous movement, closed loop control, and remote control of the mini-craft(s). This modification may also utilize resources such as the Internet, or other network resources for programming and applications.

A position feedback device, such as a CCD camera or an electromagnetic sensor may also be utilized with the present invention and may be incorporated in the modification described above to measure the current position of the mini-craft 40 and create a closed loop control for the movement of the mini-craft. The microcontroller and amplifier or driver interface may also follow a program to make the control system autonomous and/or follow a program to present tasks or challenges.

Localized sensors (optical, magnetic or other means of detecting the mini-craft), may be provided to improve the play action of the system, and LED lights to provide feedback. These modifications can also be used to start and stop a chronometer to measure the time spent to complete a predefined task. An LED grid or LCD display coupled with a magnetic sensor array may be used as a task completion feedback device and may be placed on or adjacent to one or more sides of the container, the controller, or the frame. Mini-crafts 40 may also be provided that have a miniature wireless camera that provides a view of the environment as it is maneuvered by the user to navigate around and through the various different kinds of landscapes, tunnels, obstacles and target points.

Mini-crafts 40 may also be provided that have oscillating parts that move and/or propel the craft in the fluid medium such as fins, a tail, wings, or in a jellyfish like movement, or may have a propeller or a helicopter having a rotor blade. Mini-crafts 40 may also be provided that are designed to propel by rotation, such as having a spiral form or shaped like a screw without the head. Mini-crafts 40 may also be provided that operate in a non-liquid environment having a heavier bottom portion and parts that move and/or propel the craft such as airplane having a propeller or a helicopter having a rotor blade. These types of crafts can also be used with the above described system employing the microcontroller and amplifier or driver interface and providing electromagnets 21 can be controlled such that the electromagnetic field rotates in any direction and also undulates in any plane. Multiple mini-crafts may also be provided that are designed to respond to different resonant frequencies in either undulating or rotating movements. For example, one mini-craft may be capable of following a magnetic field only to a predetermined lower frequency, and another my be capable of following a higher frequency but will not move at the lower frequency.

The magnet 41 in the mini-craft 40 may be a permanent magnet 41 or an electromagnet with a high magnetic permeability core powered by a battery in the craft body that can be turned on or off remotely.

In another modification, a hybrid system may be provided which utilize an external field as the energy transfer mechanism for autonomous or remote controlled mini-crafts. The hybrid system can power miniature electrical motors on the craft or sensors like a camera or a temperature sensor with its transmission device. It could also actuate clutches to enable or disable a moving part to react to the external fields. Moving parts, for example elements of a robot, could be moved individually by the external field.

In the exemplary embodiment(s) described above, the magnetic mini-craft 40 was briefly described as having a magnet 41 which may be fixed or free rotating inside of a plastic or foam body 42 that can have many forms or shapes, and has a close to zero buoyancy. In its simplest form, the mini-craft system operates on an "on-off" mode in the two directions of each of the three axes (x, y, and z), in other words, the mini-craft either moves or does not move in each of these directions. That is to say, when the vertical magnetic field gradient that makes the mini-craft sink (or rise) ceases, the craft will maintain the reached depth (or close to it if there is some inertia left on the mini-craft). This typically works fine with the two planes of the horizontal axis because, when there is no magnetic gradient applied, the mini-craft basically retains its last position. However, if the mini-craft is slightly buoyant, depth control may be somewhat difficult because when the magnetic gradient that is used to move it down (or sink), ceases then the mini-craft may tend to return to the surface.

Also, if the mini-craft is made of a foam material, it may be difficult to achieve zero buoyancy in a liquid environment because the foam absorbs a small amount of the liquid on its surface thus replacing air with liquid, which makes it difficult to adjust for zero buoyancy because its buoyancy will change with the time that it spends immersed in the liquid. The foam also compresses with pressure, thus, effectively changing its buoyancy as it increases its depth because of the water pressure increase. The foam, because of its open cell structure also holds miniature bubbles that may be on the walls of the container or dispersed on the liquid, which also affects its buoyancy. Therefore several modifications may be made to the mini-craft to enhance its maneuverability, and the user experience and play action.

One modification is to replace the foam body with a body or at least a hard outer shell formed of non-porous material with a smooth and slippery exterior surface, such as plastic. Such a craft may also be provided with a small adjustment screw with a fine thread so that its density can be fine tuned to become zero buoyant or until it matches the density of the fluid medium. In other words, if the screw is moved deeper into the mini-craft body the density of the mini-craft as a whole increases and vice versa.

Another modification to improve the depth control is to match the expansion coefficient of the mini-craft with the expansion coefficient of the liquid or fluid in which it is immersed to provide a zero-buoyant mini-craft that is not dependent on the temperature at least for some temperature range.

There are other ways to alter the buoyancy, however, the control modifications discussed above, such as using a closed loop control with position feedback of the mini-craft and using open loop control with "on-off" or proportional magnetic field gradients is a simple solution that allows the mini-craft to work smoothly in any direction even in their simpler form. The resulting smooth and predictable movement of the mini-craft in any axis and the fact that it will maintain its position when not pulled by the fields significantly improves the user experience compared to a buoyant craft.

Although this invention has been described fully and completely with special emphasis upon preferred embodiments, the foregoing disclosure and description of the invention is illustrative and explanatory thereof; various changes in the in the size, shape and materials, as well as in the details of the illustrated construction may be made within the scope of the appended claims without departing from the true spirit of the invention. The present invention should only be limited by the following claims and their legal equivalents.

Other Embodiments

The following embodiments describe an entertainment device comprising a fluid medium, an electromagnetic frame, and one or more mini-crafts disposed within the sides of the frame. Each mini-craft comprises a magnet and a different cutoff frequency. Motion of the mini-crafts may be controlled by a user using a controller such as joystick, remote control etc. The device comprises a processor adapted to compute, based on the multidirectional navigation signals received from the controller, electromagnetic signals for each coil in the electromagnetic frame. The electromagnetic signals are amplified and sent to the coils to generate superimposed rotating magnetic fields which cause the mini-crafts to rotate separately within the electromagnetic frame, each mini-craft following a distinct magnetic field with a frequency that is lower than its cutoff frequency.

The present document describes an educational and entertainment device. To make the device adequate for such application, it must be energy efficient and inexpensive. The cost and weight of the magnetic structure included in the device is dependent on the maximum magnetic field strength that each coil will generate. We will describe hereinbelow the design options that will help minimize the required magnetic field strength and therefore the cost of the magnetic structure, which also helps to make the system energy efficient to improve battery life on portable embodiments of the device.

Figure 4A:
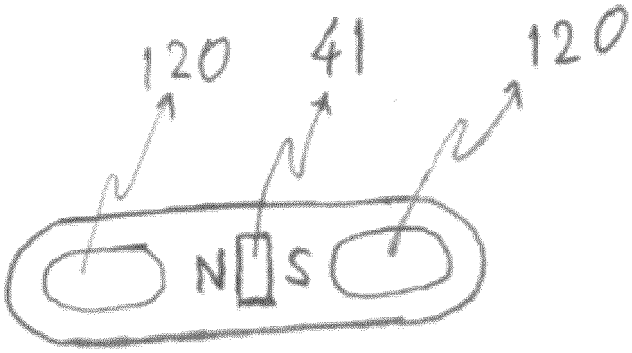
FIGS. 4*a* to 4*c* illustrate different design examples of mini-crafts including air pockets.
Figure 4B:
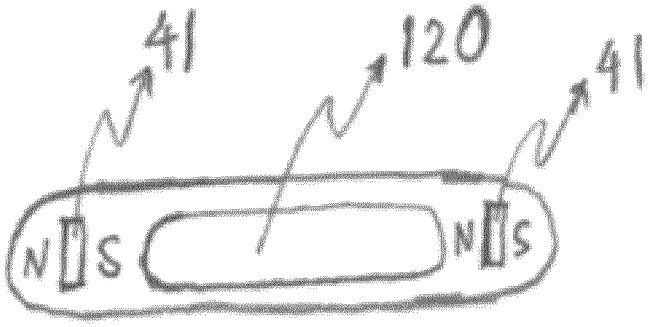
Figure 4C:
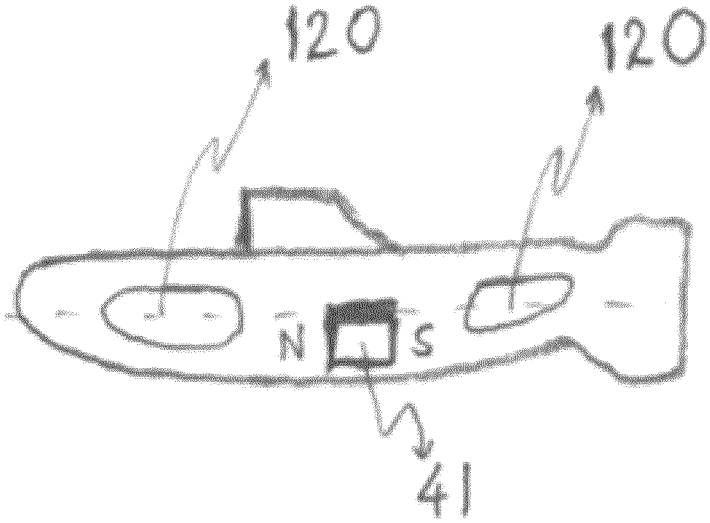

For instance, it is possible to use the strongest available magnet for its weight such as the "strongmagnets" which are also known as rare earth magnets. Furthermore, the mini-craft should have a light-density. One way of lowering the density of the mini-craft is by adding air pockets (120) inside the mini-craft as shown in FIGS. 4*a* to 4*c*, or use materials with low density.

It is also preferable to make the mini-craft buoyancy balanced, so it can be placed in any orientation without external force being applied thereon to keep it in the right position. One way to achieve this is by placing the magnet (or magnets) that will usually be denser than the fluid in the geometrical center of the mini-craft. In the case where two magnets are being used, then the magnets should be placed in an axis that is aligned with the center of buoyancy and at approximately the same distance one on each side.

Some mini-craft designs may have a right side up that must be preserved. In this case, it is possible to make the upper part of the mini-craft slightly more buoyant than the lower part, but to preserve efficiency the difference must be kept as small as possible only to achieve the correct position of the mini-craft during normal use. In this case, the magnet or magnets should be aligned so that its magnetic field will be horizontal when the mini-craft is right side up. In case we use more than one magnet all magnets north must point in the same direction. The reason why the buoyancy balance within the mini-craft is a consideration for efficiency is because when the craft is pulling up or down, it must be able to align with the field gradient to be pulled accordingly. If the mini-craft is not balanced then a larger force will be needed just to align (even partially) the mini-craft before being able to move.

Vertical Movement and Control of the Mini-Craft

As discussed above, movement of the mini-craft may be controlled in the X, Y, and Z axis. In the following description the X and Y axis define the horizontal plane, while the Z axis represents a vertical axis which is perpendicular to the horizontal plane. Accordingly, the force of gravity applies against the mini-craft in the Z axis direction. One way to deal with this is by making the mini-craft close to zero buoyant in its fluid environment, making the mini-craft behave on the Z axis like it does in the X and Y axis e.g. does not move unless a force is applied thereon.

One way for making the mini-craft close to zero buoyant in its environment is by adjusting the buoyancy of the mini-craft itself. For example, by changing its density and changing the pressure of the contained fluid which can be achieved from outside the container. We have already explained how to adjust buoyancy within the mini-craft. If the mini-craft is at least in part compressible, for example when it is made of foam type of material or has a rubber bladder filled with some gas like air if we change the pressure of the fluid in the container we will cause the mini-craft to decrease its volume therefore decreasing also its buoyancy. If we design the mini-craft to be slightly buoyant we can adjust the fluid pressure to make the mini-craft dose to zero-buoyant or slightly negative buoyant. We can control the fluid pressure externally to control the Z axis position of a compressible mini-craft. Either manually or using an electrical servomechanism that increases or decreases the fluid pressure. One way of achieving this is using a piston that can display fluid in or out of the container. For better results, the container must be hermetic so the fluids included therein do not escape.

Figure 5:
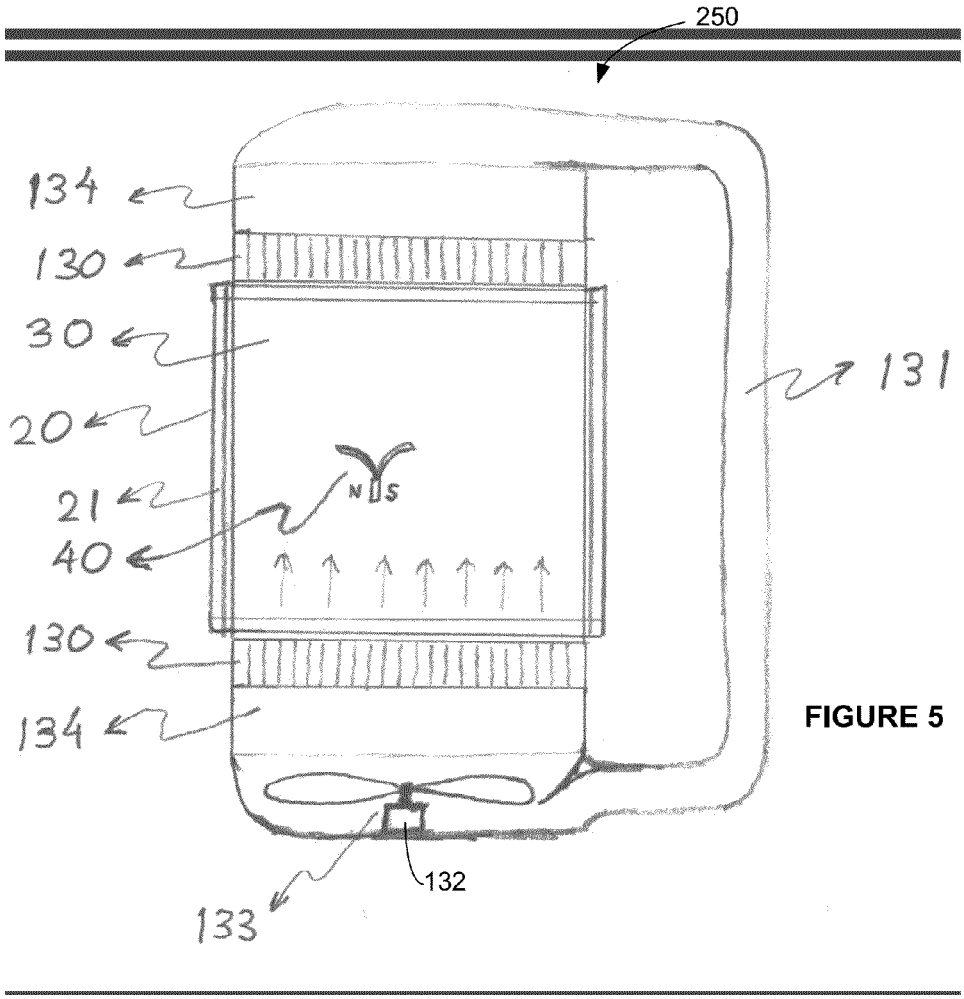
FIG. 5 illustrates an exemplary device for flowing the fluid upward in order to render a negative buoyant mini-craft behave as a zero buoyant mini-craft in the fluid surrounding it, in accordance with an embodiment.

In another embodiment, it is possible to make a negative buoyant mini-craft behave as if it were close to zero buoyant in its environment by forcing the fluid to flow vertically (upward) in the opposite direction of the force of gravity, making the mini-craft float as if it is substantially zero buoyant with respect to the fluid surrounding it. FIG. 5 illustrates an exemplary device for such application.

As shown in FIG. 5, the device 250 comprises a magnetic structure 20 surrounding or inside a transparent container (30). In the present embodiment, the container 30 is opened at its bottom and top to allow the upward flow of the fluid. The device 250 comprises a propeller 133 connected to a motor 132 to rotate it to force the fluid to flow upward vertically through the container pushing a negative buoyant mini-craft 40 upward. The propeller is provided at an open end of a feedback pipe 131 to ensure a continuous circulation of the fluid in the container 30 without having to add fluid. By adjusting the speed of the propeller 133 it is possible to make the negative buoyant mini-craft behave as a zero-buoyant mini-craft in its fluid environment, and maintain its position with respect to the Z-axis. Alternatively, the rotation speed of the propeller 133 may be adjusted to control the vertical movement of the mini-craft 40 along the Z axis e.g. increasing the speed of the propeller to push the mini-craft upward or lowering the speed to allow the mini-craft to sink downward.

The feedback pipe 131 is not needed in case the container is surrounded by the fluid. For example, if we use air as fluid or if the system is inside a larger container e.g. if a gap exists between the container 30 and the walls of the device 250. An alternative design is to have no transparent container 30, so the mini-craft can even be driven to go outside the magnetic structure 20.

Figure 6A:
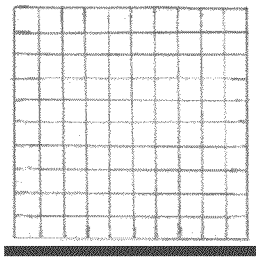
FIG. 6*a* is a top view of a grid of pipes in accordance with an embodiment.
Figure 6B:
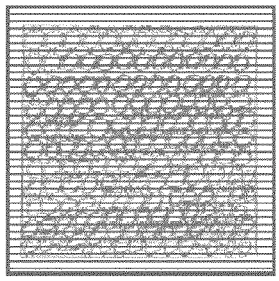
FIG. 6*b* is a top view of a grid of pipes in accordance with another embodiment.

In an embodiment, the device may comprise a pressure distribution chamber 134, and a parallel grid of pipes 130 for minimizing turbulent flow that will cause the mini-craft to behave erratically. The distribution chamber 134, and the parallel grid of pipes 130 may be provided at both open ends of the container 30, as shown in FIG. 5. In an embodiment, the pipes 130 have their length larger than their width. FIG. 6*a* is a top view of a grid of squared pipes in accordance with an embodiment, and FIG. 6*b* is a top view of a grid of rounded pipes in accordance with another embodiment. Another common grid of pipes which may be used (not shown) is known as the honeycomb structure.

Some variations to this design are possible, for example, the propeller 133 may be placed at the top or it could be substituted by a fluid pump placed in some part of the fluid feedback pipe 131. It is also possible to invert the direction of fluid flow between upward and downward and adjust its speed to control the vertical motion and speed of the mini-craft 40 along the Z-axis. In this case, the mini-craft 40 may be buoyant.

Superimposed Magnetic Fields and Gradient Generator

Figure 7A:
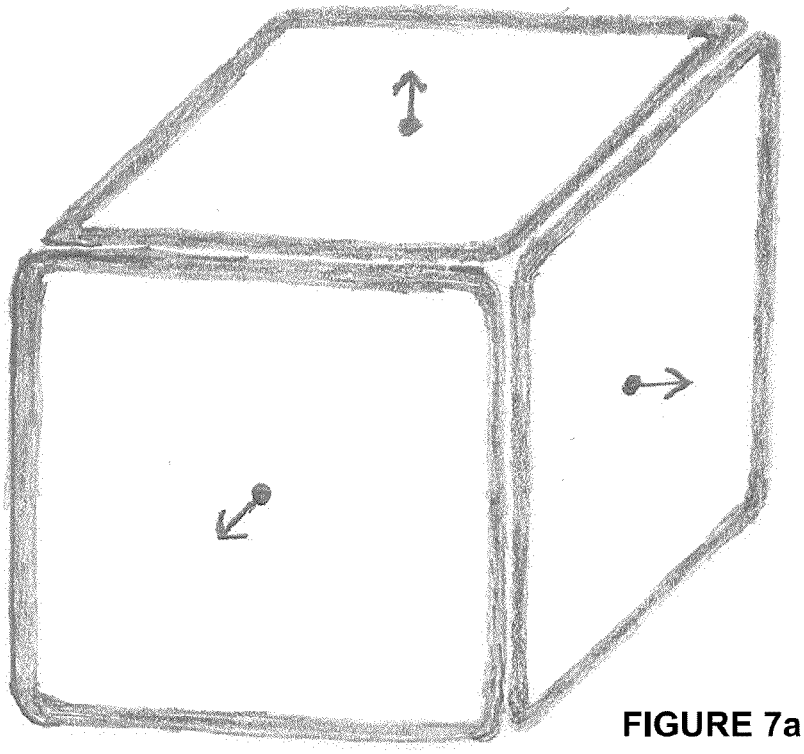
FIG. 7*a* illustrates a cube having a squared coil at each one of its faces.
Figure 7B:
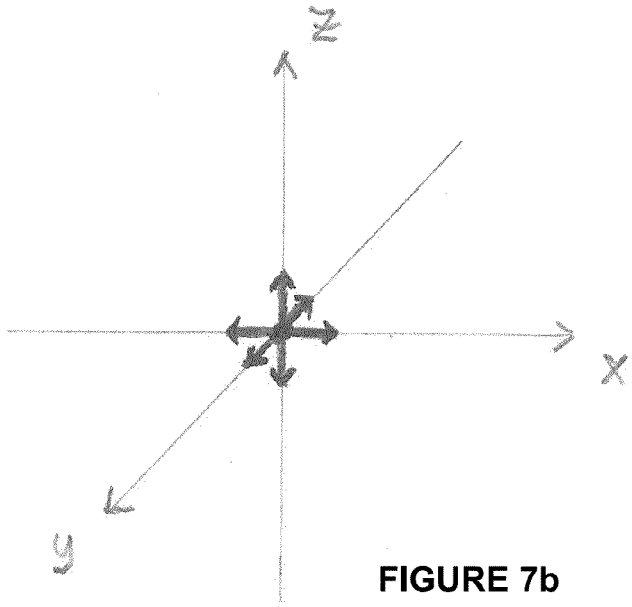
FIG. 7*b* illustrates the normal vectors for the six coils in the magnetic structure of FIG. 7*a;*

As described earlier, the present embodiments describe a magnetic structure composed of several coils each one placed in a face of a closed 3D geometric shape. The coils do not have to be the same shape of the surface edge but just be in the same plane, for example using a cube the coils could be of a circular shape parallel and centered on each cube face. The coils could also be different from each other in shape and/or size. It is preferable but not necessary to have symmetrical shapes where each face has an identical face on the other side of the 3D geometric shape. The simplest form of this structure using coil pairs is known in the art as triaxis Helmholtz coils. The triaxis Helmholtz coils is formed of a pair of coils for each orthogonal axis of a 3D coordinate system. One such arrangement could be a cube where each one of the faces has a square coil, as shown in FIG. 7*a*. FIG. 7*b* illustrates the normal vectors for the six coils in the magnetic structure of FIG. 7*a*.

Figure 8A:
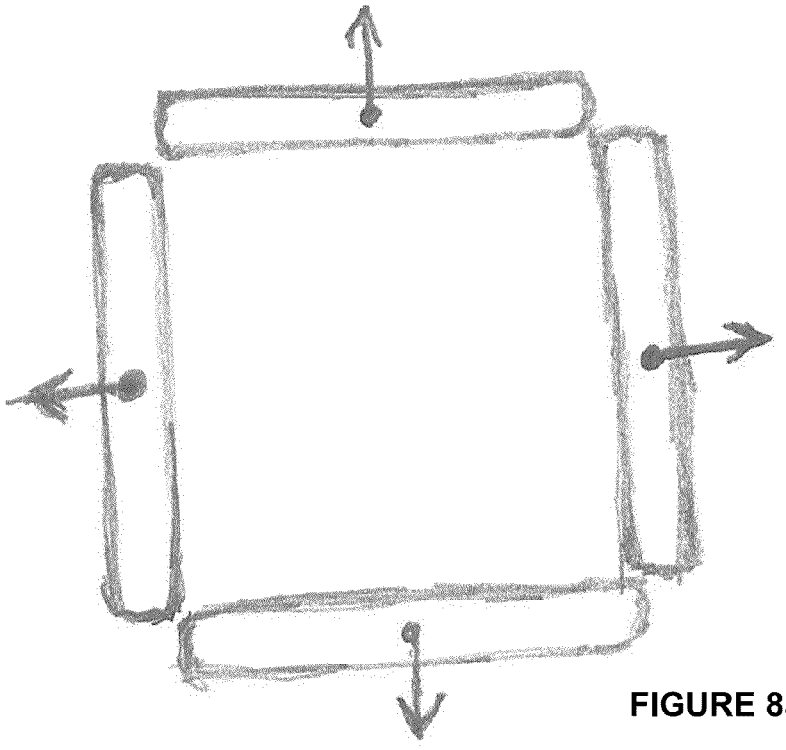
FIG. 8*a* is a cross section view of the magnetic structure of FIG. 7*a* with the horizontal plane and their corresponding normal vectors.
Figure 8B:
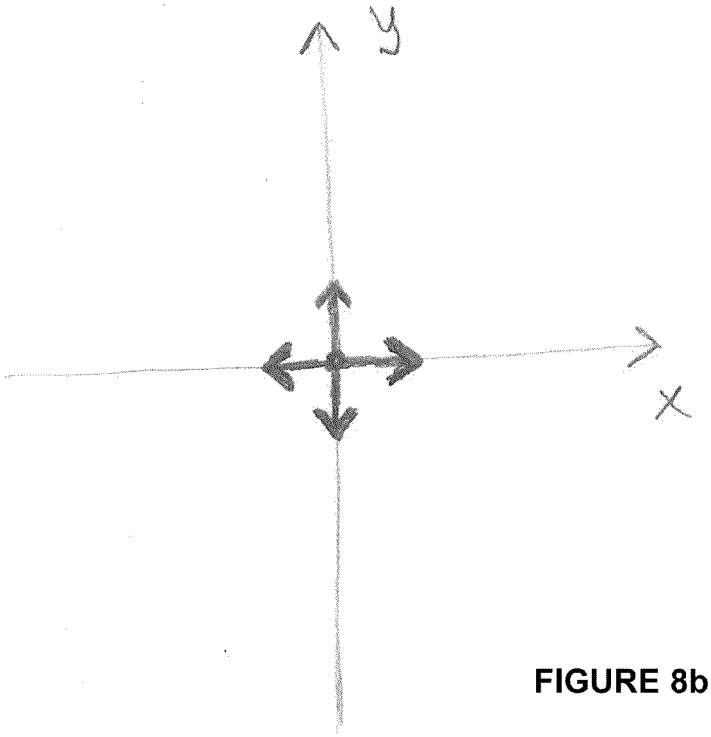
FIG. 8*b* illustrates the normal vectors in the x-y plane for the coils in the magnetic structure of FIG. 8*a;*
Figure 9A:
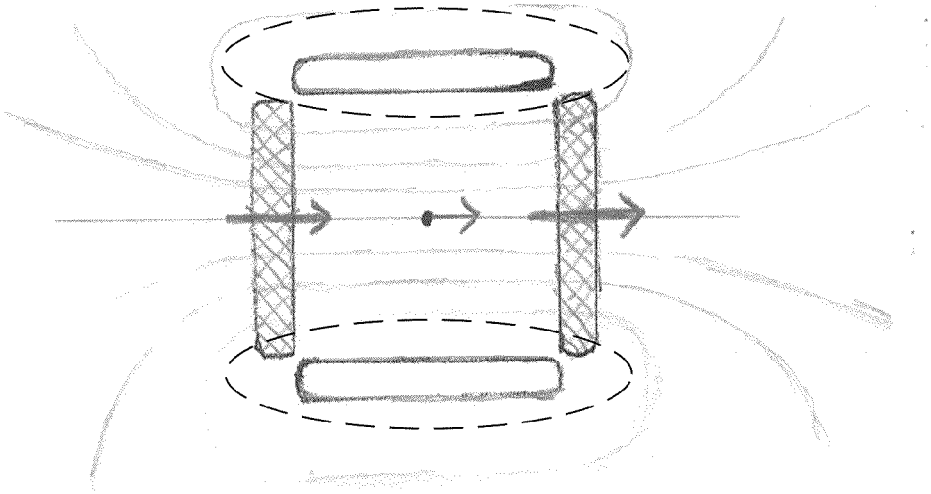
FIG. 9*a* is a cross section of magnetic structure from FIG. 8*a* showing magnetic lines of a uniform magnetic field with 0 degrees of azimuth angle wherein hashed coils are the energized coils.
Figure 9B:
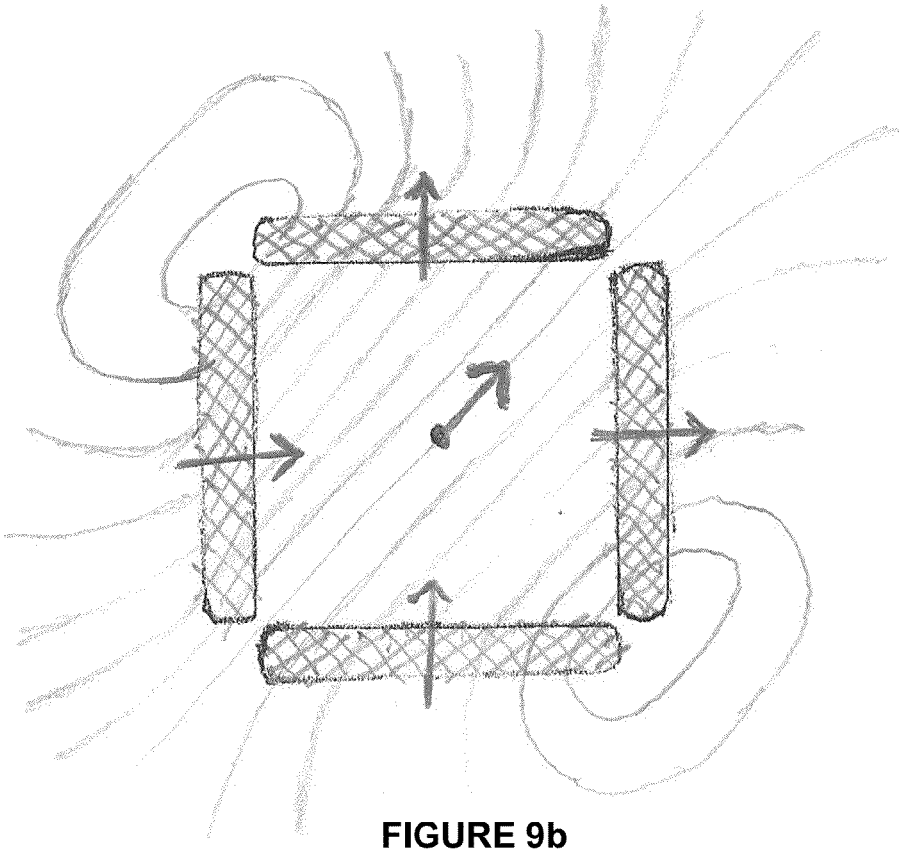
FIG. 9*b* is a cross section of a magnetic structure from FIG. 8*a* showing magnetic lines of a uniform magnetic field with 45 degrees of azimuth angle wherein hashed coils are the energized coils.
Figure 10:
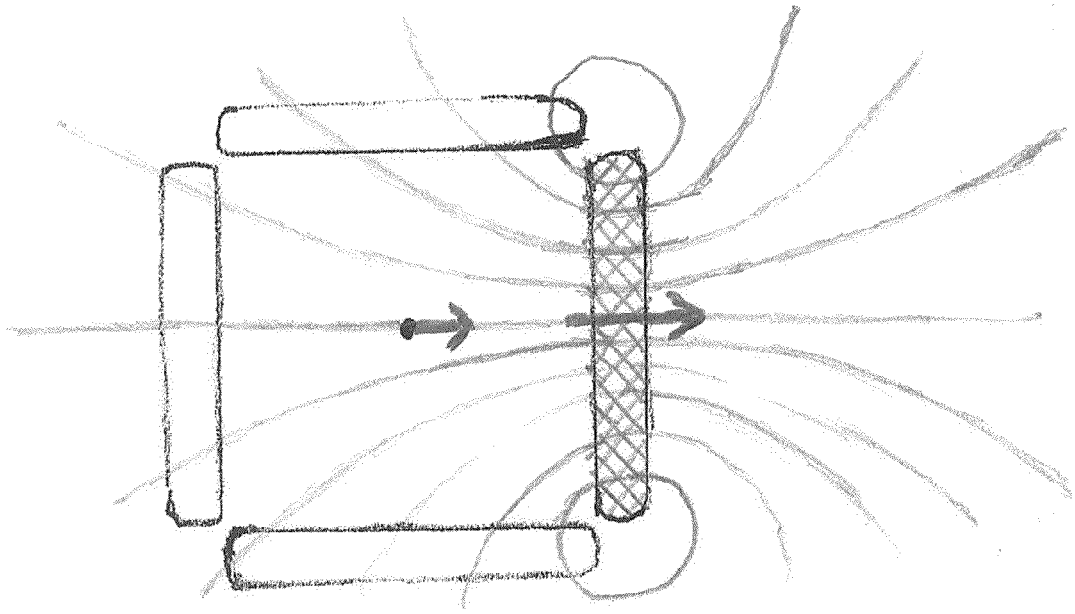
FIG. 10 is a cross section of magnetic structure from FIG. 8*a* showing magnetic lines of a gradient magnetic field with 0 degrees of azimuth angle wherein the hashed coils are the energized coils.

The magnetic structures illustrated in FIG. 7*a* may be used to generate magnetic field vectors as shown in FIGS. 9*a* and 9*b* and gradients as shown in FIG. 10, in any 3d direction on a region inside the structure or gradients outside the structure. FIG. 8*a* is a cross section view of the magnetic structure of FIG. 7*a* with the horizontal plane and their corresponding normal vectors. FIG. 8*b* illustrates the normal vectors in the x-y plane for the cons in the magnetic structure of FIG. 8*a*. FIG. 9*a* is a cross section of magnetic structure from FIG. 8*a* showing magnetic lines of a uniform magnetic field with 0 degrees of azimuth angle, wherein hashed coils are the energized coils. FIG. 9*b* is a cross section of a magnetic structure from FIG. 8*a* showing magnetic lines of a uniform magnetic field with 45 degrees of azimuth angle wherein hashed coils are the energized coils. FIG. 10 is a cross section of magnetic structure from FIG. 8*a* showing magnetic lines of a gradient magnetic field with 0 degrees of azimuth angle wherein the hashed coils are the energized coils.

Figure 11A:
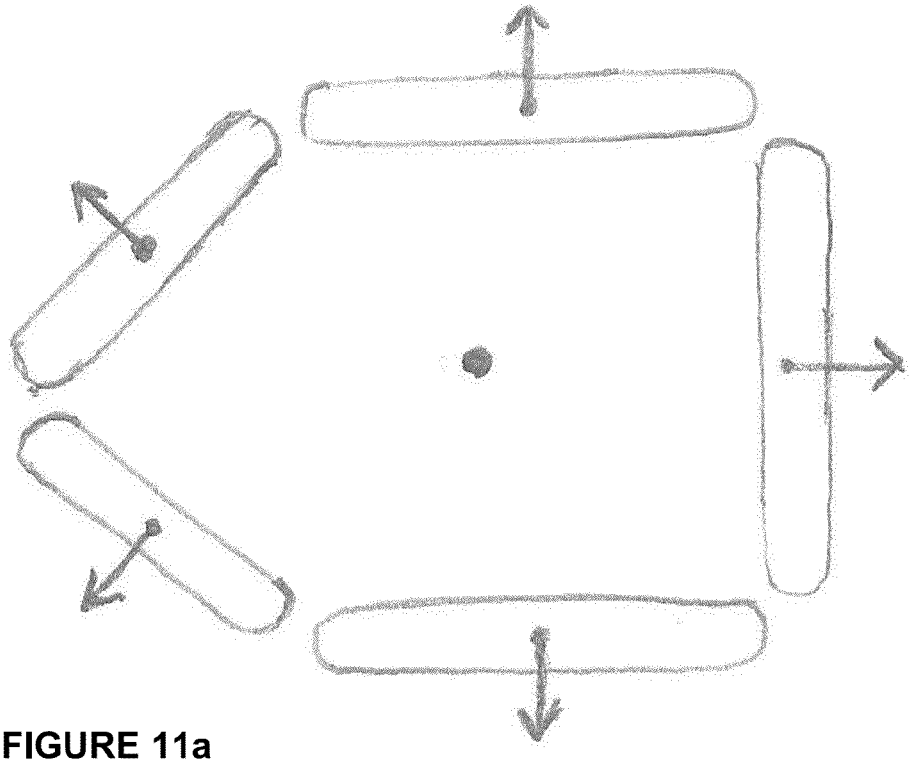
FIG. 11*a* is a cross section of a magnetic structure showing five coils and their corresponding normal vectors, in accordance with an embodiment.
Figure 11B:
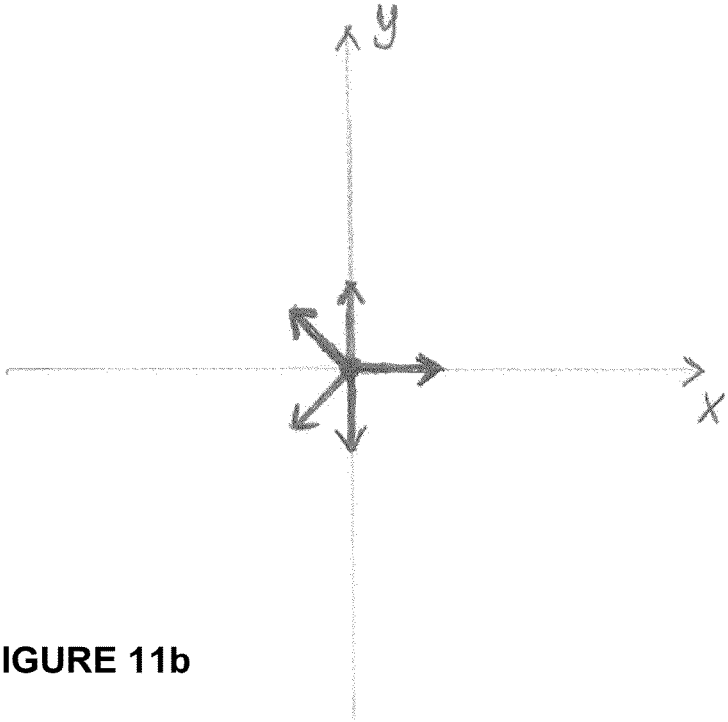
FIG. 11*b* illustrates the normal vectors in the x-y plane for the coils in the magnetic structure of FIG. 11*a;*

While FIG. 8*a* shows the magnetic structure in the form of a cube with six sides, it should be noted that the device can take various shapes without departing from the scope of this disclosure. For instance, FIG. 11*a* is a cross section of a magnetic structure showing five coils and their corresponding normal vectors, in accordance with an embodiment, FIG. 11*b* illustrates the normal vectors in the x-y plane for the coils in the magnetic structure of FIG. 11*a*.

Figure 12:
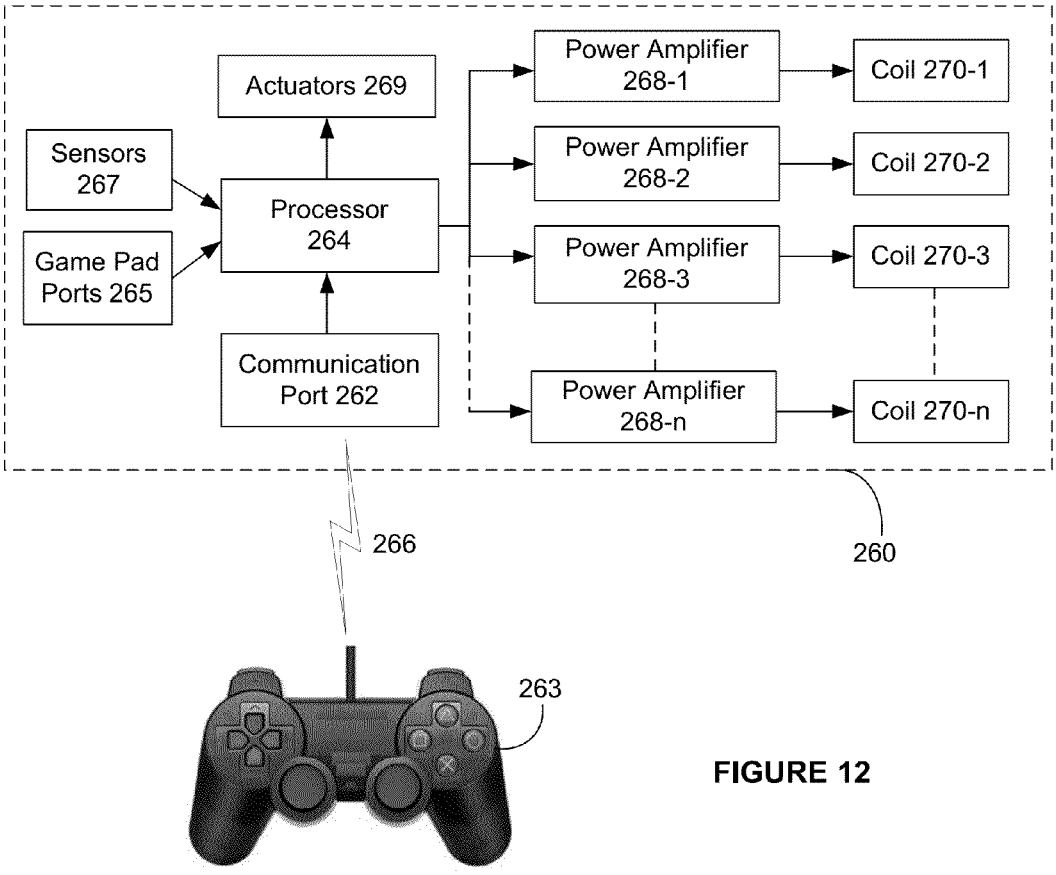
FIG. 12 is a block diagram of an entertainment device in accordance with an embodiment

FIG. 12 is a block diagram of an entertainment device in accordance with an embodiment. As shown in FIG. 12, an entertainment device 260 in accordance with an embodiment comprises a communication port 262 for receiving control signal from a controller 263 via a communication link 266. In the example of FIG. 12, the controller is shown as being a joystick, however other types of controller may be used which are known in the market. Furthermore, the link 266 may be a wired link, a wireless link or a combination of both. The control signals include motion commands to move the mini-craft along each of the X, Y, and Z axis.

Control signals received at the communication port 262 from the controller 263 are sent to a processor 264. The processor 264 may include one or more processing cores for computing the signals to be sent to each coil in the electromagnetic structure, based on the control signals received from the user (through the controller 263). Once the signals are calculated, each signal would be sent to a power amplifier 268 to amplify the signal before feeding it to the corresponding electromagnetic coil 270 of the magnetic structure.

The device may also include game pad ports 265, sensors 267, and actuators 269 connected to the processor 264. The game pad ports 265 are sockets to connect game pads (or game controllers) similar to the sockets that are present in a game console to plug wired game controllers. The sensors 267 are ports to connect for example a web cam or a magnetic sensor. This has been described in some of the embodiments as being used for closed loop control, and also as Localized sensor. The actuators 269 are ports to connect different devices for example the LED's, or the motor 132 of the propeller 133 shown in FIG. 5.

Figure 13:
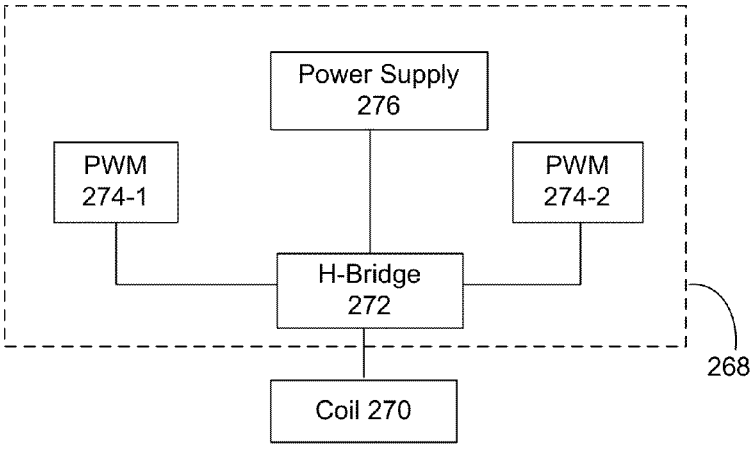
FIG. 13 is a block diagram of a bi-directional power amplifier in accordance with an embodiment.

FIG. 13 is a block diagram of a bi-directional power amplifier in accordance with an embodiment. In the example of FIG. 13, the power amplifier 268 is a bidirectional power amplifier comprising an H-Bridge 272 and two pulse width modulators 274 PWM. The PWMs 274 may be connected to the output of the processor 264 to control its pulse width values. The H-bridge 272 is connected to a power supply 276. Output of the H-bridge is fed into an electromagnetic coil 270 of the magnetic structure.

It is also possible to use other arrangements of electrical signal power amplification such as power semiconductors in a linear amplification configuration similar to the ones used for audio signals power amplification to drive loudspeakers etc.

Figure 14A:
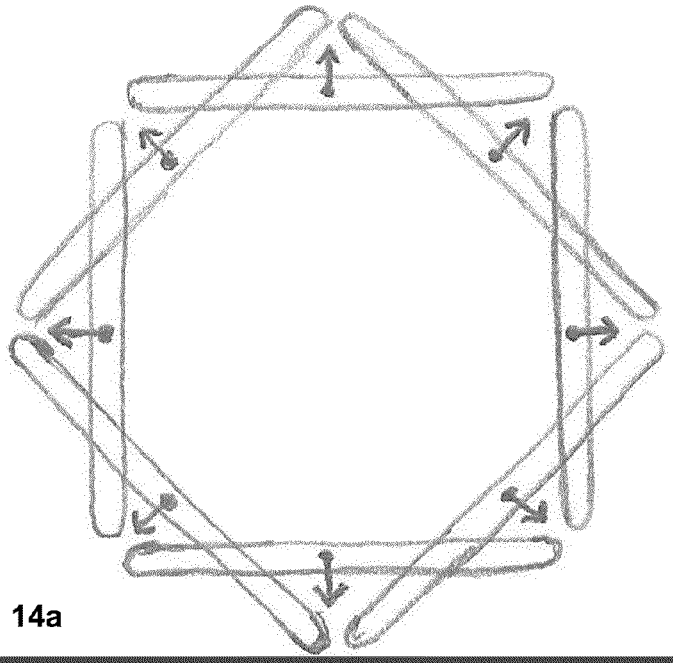
FIG. 14*a* is cross section of a magnetic structure showing 8 coils and their corresponding normal vectors, wherein the coils are arranged in an overlapped configuration.
Figure 14B:
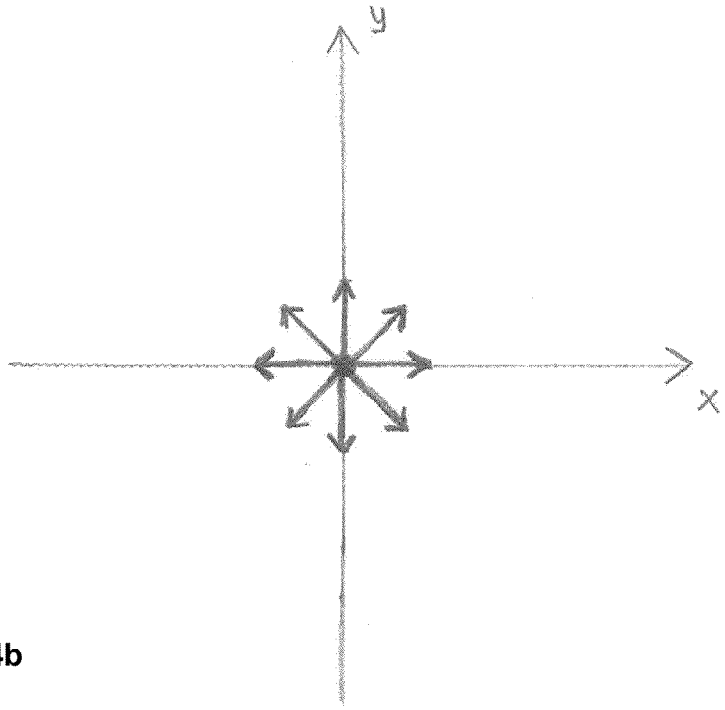
FIG. 14*b* illustrates the normal vectors in the x-y plane for the coils in the magnetic structure of FIG. 14*a;*

To achieve more precision when generating this magnetic fields one can use geometric shapes with more faces or overlapping coils as shown in FIG. 14*a*. FIG. 14*a* is cross section of a magnetic structure showing 8 coils and their corresponding normal vectors, wherein the coils are arranged in an overlapped configuration. FIG. 14*b* illustrates the normal vectors in the x-y plane for the coils in the magnetic structure of FIG. 14*a*. An example using overlapped coils could be to use two cubic triaxis Helmholz one with the faces centered on each vertex of the other.

In an embodiment, the magnetic structure generates magnetic fields and magnetic field gradients with arbitrary 3D orientation, within the limits of the structure. For example the magnetic field intensity will be constrained to the maximum combined magnetic field strength on any given orientation that the coils of the structure can produce. To calculate the power required to produce each type of magnetic field we use the vector normal to each coil plane (see FIGS. 7*a* to 11*b*, 14*a*, and 14*b*).

Definitions

Uniform Magnetic Field: A uniform magnetic field is where the magnetic lines are parallel. For each coil: UniformFieldCoilPower=UniformMagneticFieldDirectionVector*CoilNormalVector (see FIG. 9*a* and FIG. 9*b*).

Gradient Magnetic Field: A gradient magnetic field is where the magnetic field lines are not parallel but tend to get closer (see FIG. 10). For each coil: GradientFieldCoilPower=Maximum (0 GradientMagneticFieldDirectionVector*CoilNormalVector).

Generation of Rotating/Undulating Magnetic Fields

Figure 15:
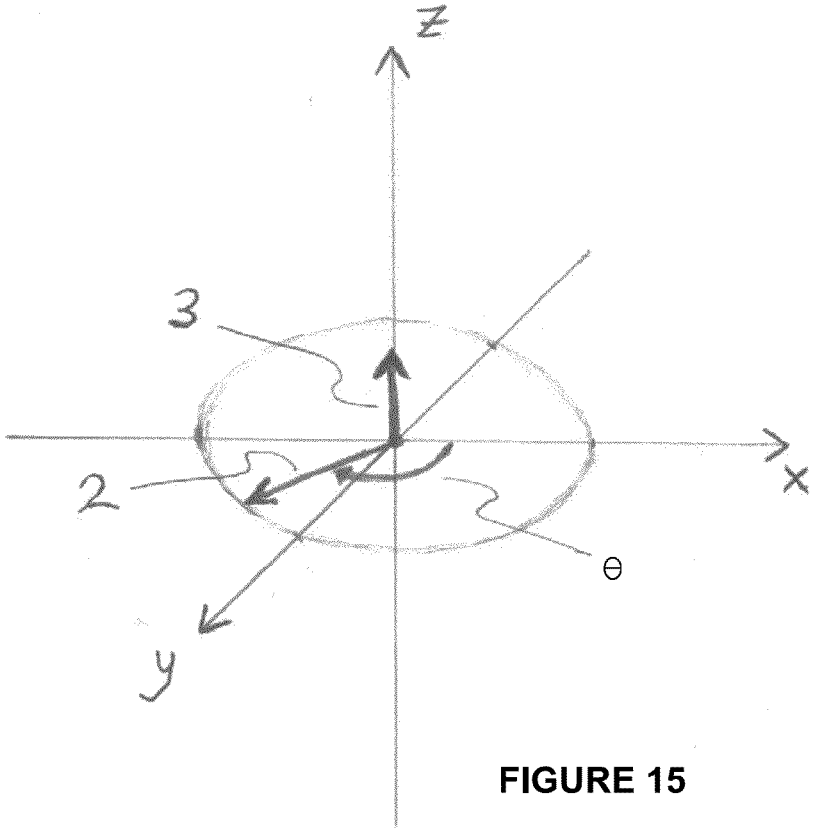
FIG. 15 illustrates an example of a rotating magnetic field in the X-Y plane, in accordance with an embodiment.

As shown in the preceding equations, if it is possible to change the orientation of the field with time to generate rotating magnetic fields or undulating magnetic fields. A rotating magnetic field is a magnetic field whose orientation angle changes with time. We can rotate a magnetic field uniform or gradient around an arbitrary tri-dimensional vector. FIG. 15 illustrates an example of a rotating magnetic field in the X-Y plane, in accordance with an embodiment. In the example shown in FIG. 15, θ represents the rotation angle (⊖32 rotation speed*time), 2 represents the rotation vector, and 3 represents a vector normal to the rotation plane X-Y. For each coil: RotatingFieldCoilPower=RotatingMagneticFieldVector*CoilNormalVector.

An undulating magnetic field can be generated by taking a magnetic field with some 3D orientation and change its magnitude with time with a periodic wave function, for example a sine wave function. For each coil: UndulatingFieldCoilPower=UndulatingMagneticFieldVector*PeriodicWaveMagnitude*CoilNormalVector.

It is possible to add an offset to the rotating magnetic field. The offset is oriented to an arbitrary direction of a tridimentional vector. The field will be stronger as the rotation vector orientation gets closer to the gradient orientation vector and weaker as it gets closer to the negative side of the gradient orientation vector. For each coil: RotatingFieldWithOffsetCoilPower=RotatingFieldCoilPower*(1+RotatingMagneticFieldVector*RotatingMagneticFieldOffsetDirectionVector/(Maximum|RotatingMagneticFieldVector|*RotatingMagneticFieldOffsetDirectionVector|))

Accordingly, it is possible to produce more than one of the previously described magnetic fields using superimposition by adding the calculated power of each coil required by each of the fields that we want to superimpose. This is specially useful when adding many rotating fields each having a different angular-speed and possibly combine this with one gradient or uniform field.

For each coil: CoilPower=(UniformFieldCoilPower or GradientFieldCoilPower)+RotatingFieldWithOffsetCoilPower1+RotatingFieldWithOffsetCoilPower2+ . . . RotatingFieldWithOffsetCoilPowerN+UndulatingFieldCoilPower1+UndulatingFieldCoiPowerN.

Independent Control of Multiple Mini-Crafts

In addition to being able to have a superimposed static magnetic field and/or a magnetic gradient in any 3D direction and with different rotation frequencies as discussed above, the Magnetic Structure may be used to achieve independent control of more than one mini-craft, in accordance with a further embodiment of the invention. The control of the mincrafts is based on the shape and size of each mini-craft, without adding any electrical system or component to the mini-craft such as a receiver, transmitter, or any similar circuitry. Motion of the mini-craft is based on a magnetic torque from the mini-craft's own magnet trying to align with a rotating magnetic field, whereby, as the magnetic field rotates so does the magnet which always tries to align itself with the rotating magnetic field. Therefore, since the rotating magnetic field may be generated from any of the coils in the electromagnetic frame, it is possible to rotate and move the mini-craft in any direction within the fluid medium. Higher precision of movement may be achieved with overlapping coils as shown in FIGS. 14*a* and 14*b*.

Figure 16:
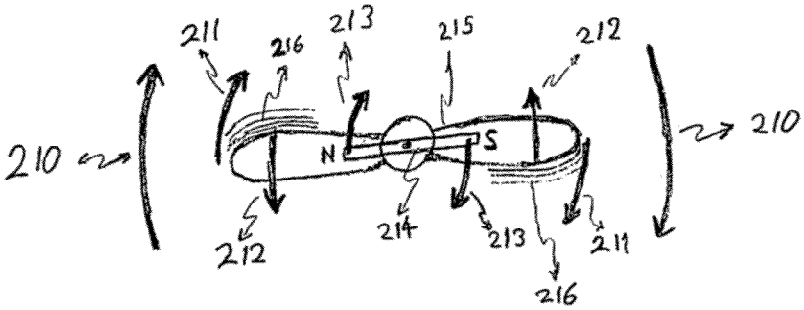
FIG. 16 illustrates a mini-craft having the shape of a propeller.

When a rotating magnetic field is present, each mini-craft will have a magnetic torque from its magnet trying to align with the magnetic field orientation. When an object moves inside a fluid there will be a drag force opposite to the direction of the movement. The same principle applies to an object that rotates inside a fluid, in this case there will be a drag torque opposite to the direction of rotation. FIG. 16 illustrates a mini-craft having the shape of a propeller, in accordance with an embodiment. The mini-craft 215 comprises a magnet 214. Arrows 210 represent the direction of the generated rotating magnetic field by a surrounding magnetic structure (not shown). Arrows 211 represent the direction of rotation of the mini-craft. Arrows 212 represent the drag torque that opposes the rotation movement of the mini-craft. Lines 216 represent the fluid pressure against the surface of the propeller perpendicular to the direction of rotation. This fluid pressure is what generates the drag torque. Arrows 213 represent the torque that the magnet generates while trying to align itself with the rotating magnetic field.

When the drag torque having an opposite direction of rotation is lower than the torque 213 from the magnet trying to align with the field, then the mini-craft 215 will rotate in sync with this rotating magnetic field applied in the fluid medium within which the mini-craft is located. However, an angular frequency exists for a given magnetic field power where the drag torque is equal to the magnetic torque and this frequency is called the cutoff frequency (wc). Beyond the cutoff frequency the mini-craft will no longer be able to follow the rotating magnetic field and will stop rotating.

The cutoff-frequency is where the magnetic torque equals the rotation drag torque. Therefore it is possible to alter the cutoff-frequency for a given design of mini-craft by changing the size and/or strength of the magnet. It is also possible to change the cutoff-frequency by changing the shape of the mini-craft so that it will have more or less drag torque for a given rotation speed. For example, in a mini-craft with the shape of a propeller, we can alter the drag torque for a given rotation speed by changing the angle of attack of the propeller blades, alternatively we can increase the drag torque for a given rotation speed if we increase the size (scale) of the propeller.

The angle of attack is the acute angle between the chord line of a propeller blade and the relative wind. The thrust produced by a propeller, in the same way as lift produced by a wing, is determined by the blade's angle of attack. This term is a well known term in a propeller fluid dynamics.

The cutoff frequency depends on a series of parameters including parameters that are external to the mini-craft and parameters that are internal to it.

External parameters affect each mini-craft which is present within a given magnetic field and a given fluid. The external parameters include the generated magnetic field strength which is directly correspondent to the cut-off frequency, and the fluid viscosity which is inversely correspondent to the cut-off frequency. In this context, two parameters are said to be directly correspondent when an increase in one parameter reflects an increase in the other parameter and vice-versa. The decrease/increase may be linear or non-linear. Similarly, two parameters are said to be inversely correspondent when an increase in one parameter reflects a decrease in the other parameter and vice versa. The decrease/increase may be linear or non-linear.

Figure 17A:
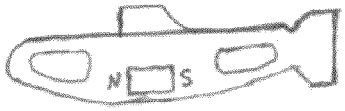
FIGS. 17*a* to 17*c* illustrate different types of mini-crafts each having a different cutoff frequency.
Figure 17B:
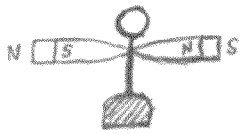
Figure 17C:
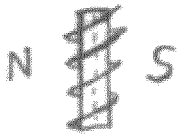
Figure 18:
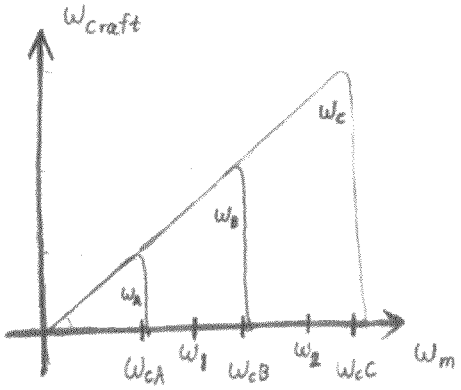
FIG. 18 is a graph of a rotating magnetic field angular frequency Wm vs. craft angular frequency Wcraft for the mini-crafts illustrates in FIGS. 17*a* to 17*c;*

The internal parameters are specific to each mini-craft individually. These parameters may be adjusted in order to set the cut-off frequency of a specific mini-craft to a certain value. Whereby, different cutoff frequencies may be set for different mini-crafts to selectively control one mini-craft or the other. The internal parameters include:

- The size of the mini-craft (inversely correspondent to the cutoff frequency);
  - The roughness of the material of which the mini-craft is made is (inversely correspondent to the cutoff frequency);
  - The surface area perpendicular to the direction of rotation that is in contact with the fluid (inversely correspondent to the cutoff frequency);
  - The magnet strength (directly correspondent to the cutoff frequency);
- The magnet size (directly correspondent to the cutoff frequency);
- The angle of attack (0° to 90°) of mini-crafts having the shape of a propeller (inversely correspondent to the cutoff frequency);

FIGS. 17*a* to 17*c* illustrate different types of mini-crafts each having a different cutoff frequency. FIG. 18 is a graph of rotating magnetic field angular frequency Wm vs. craft angular frequency Wcraft for the mini-crafts illustrates in FIGS. 17*a* to 17*c*. The graph also shows two frequencies that we will use to control mini-craft B and mini-craft C ($w_B$, $w_C$). They are about in the middle of the range between their corresponding craft cutoff frequency and the craft with immediate lower cut-off frequency.

As stated above, each rotating field can have an arbitrary 3D direction. We will use this to control the direction where we want to move a mini-craft.

By providing a sufficient gap between the adjacent cutoff-frequencies of the different mini-crafts, the mini-crafts with lower cutoff-frequencies would not follow the rotating fields of other mini-crafts with higher cutoff frequencies. The process should begin by controlling the mini-craft having the highest cutoff-frequency. In our case we will start a rotating magnetic field with $w_C$ angular frequency. Only the mini-craft of FIG. 17*c* will be able to follow this rotation frequency. The other two mini-crafts may vibrate but they cannot be displaced from theft position. Subsequently, we apply a second superimposed rotation magnetic field with angular frequency $w_B$ which corresponds to a frequency within the range of the second from highest cutoff frequency mini-craft. The mini-craft FIG. 17B will start to follow the $w_B$ angular frequency. It is important to note that the mini-craft or mini-crafts with higher cutoff frequency than $w_S$ even though they are able to follow this frequency because its below their cutoff-frequency, they are already rotating at a higher angular frequency and their inertia will keep them from following other rotating magnetic fields with lower angular frequency as long as the rotating magnetic field that they are currently following does not stop.

The process continues by rotating magnetic fields from higher to lower until we are only left with the mini-craft with the lowest cutoff-frequency. For this mini-craft, it is possible to use a lower rotation than its cutoff frequency like for the other mini-crafts or simply it may be moved with gradient magnetic fields depending on its design. In our example the mini-craft shown in FIG. 17*a* is designed to follow gradient magnetic fields. By selecting the orientation of each superimposed rotating magnetic field and the orientation and intensity of the superimposed gradient magnetic field we can independently move these 3 mini-crafts in this example.

Note that the described procedure implies that before being able to control some mini-craft we should start moving all the mini-crafts that have higher cutoff-frequency. This and the fact that for a given magnetic field strength the more stable frequency to move each mini-craft is more or less defined or at least within a small range of frequencies. This adds to the previous observation the fact that the mini-crafts will move at an approximately constant speed and keep moving every time we want to move a mini-craft with lower cutoff-frequency. It is possible to use one of two possible techniques to overcome this limitation independently if we are using an open loop or closed loop control system.

Figure 19:
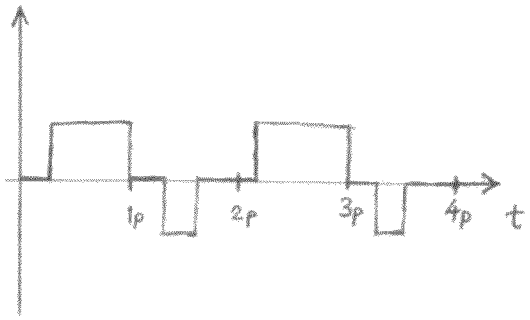
FIG. 19 is a graph depicting an example of periodic waveform used to control movement speed of a rotating mini-craft.

The first solution is to move the mini-crafts in small circles by rotating the orientation of their rotating magnetic fields when we do not intend to change their position. The other solution is to interleave the movement and change their rotation direction each time they have to move so we can move back and forth by the same amount of time. It is also possible to control the mini-craft speed by varying this forward pulse time and backward pulse time depending on the desired result, as shown in FIG. 19. FIG. 19 is a graph depicting an example of periodic waveform used to control movement speed of a rotating mini-craft.

It is important to note that the cutoff frequencies are dependent on the magnetic field intensity. Therefore, we should use more than half the maximum power of each coil and keep it constant to have the best power transmission from the rotating magnetic fields to the rotating mini-crafts. It is important to avoid selected frequencies that are close to multiples of each other to avoid interference patterns. This is possible since we will have a range of frequencies from which to select for each mini-craft.

It is also important to note that it is also possible to design mini-crafts that move with undulating magnetic fields for example a dorsal fin movement on a fish like mini-craft. It is also possible to use the same techniques described herein to control more than one undulating mini-craft design with different cutoff frequencies for a given magnetic field strength. We can also mix undulating with rotating mini-crafts as long as each one has different cutoff-frequency for a given field strength.

A magnetic field generator in accordance with the present embodiments may comprise a tridimensional (3D) magnetic structure, a power amplifier for each coil, a signal generator, a communication interface and/or user interface device such as a game controller.

The magnetic structure may include several coils each one placed in a face of a closed 3D geometric shape. The coils do not have to be the same shape of the surface edge but just be in the same plane, for example using a cube, the coils could be of a circular shape parallel and centered on each cube face. The coils could also be different from each other in shape and/or size. It is preferable but not necessary to have symmetrical shapes where each face has an identical face on the other side of the 3D geometric shape. The simplest form of this structure using coil pairs is known in the art as triaxis Helmholtz coils, this is formed with a pair of coils for each orthogonal axis of a 3D coordinate system. One such arrangement could be a cube where each one of the faces has a square coil as shown in FIG. 5.

Figure 20:
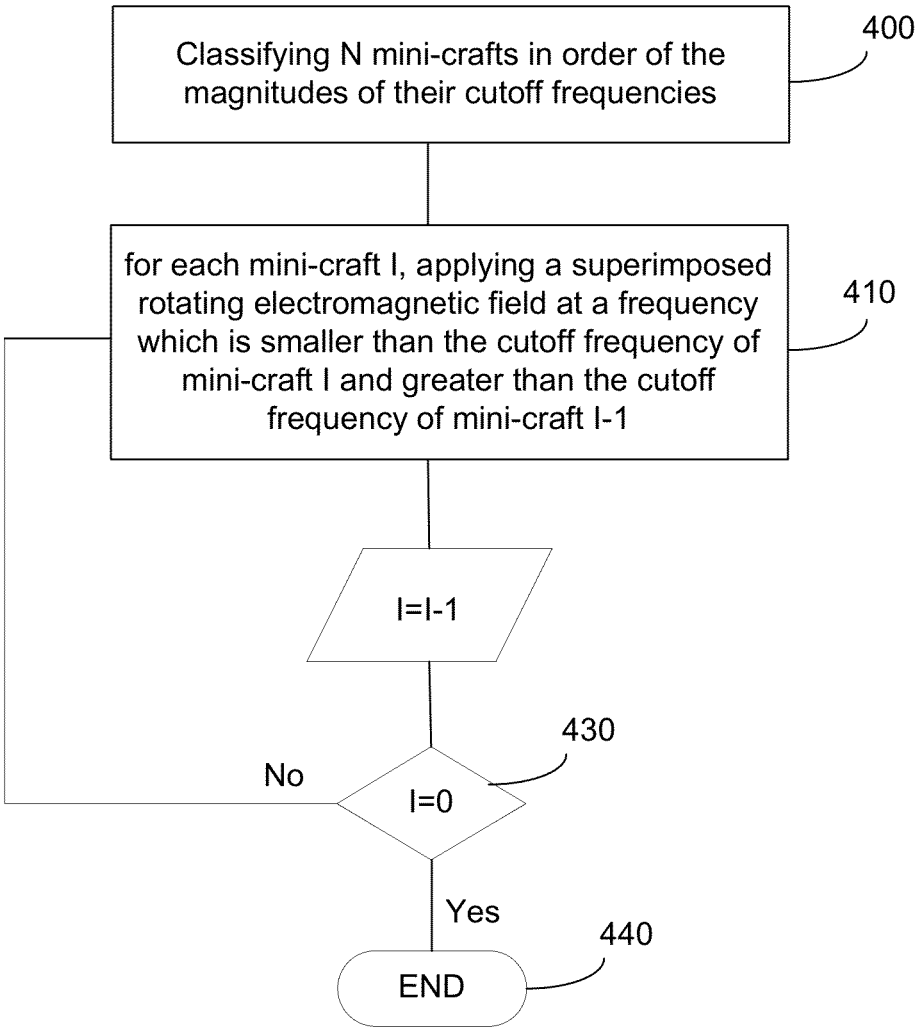
FIG. 20 is a flowchart of a method for independently controlling the motion of multiple mini-crafts in a fluid medium.

FIG. 20 is a flowchart of a method for independently controlling the motion of multiple mini-crafts in a fluid medium magnetically, where the mini-crafts have different cutoff frequencies. The method begins at step 400 by classifying N mini-crafts in order of the magnitudes of their cutoff frequencies. At step 410, for each mini-craft I, applying a superimposed rotating electromagnetic field at a frequency which is smaller than the cutoff frequency of mini-craft I and greater than the cutoff frequency of mini-craft I–1. The process is repeated until all the mini-crafts are controlled. At step 430, if there is more mini-crafts to control the step 410 is repeated for a mini-craft with lower cutoff frequency. Otherwise, if it is determined at step 430 that there is no more mini-crafts to control, the process ends at step 440.

Embodiments can be implemented as a computer program product for use with a computer system. Such implementation may include a series of computer instructions fixed either on a tangible medium, such as a computer readable medium (e.g., a diskette, CD-ROM, ROM, or fixed disk) or transmittable to a computer system, via a modem or other interface device, such as a communications adapter connected to a network over a medium. The medium may be either a tangible medium (e.g., optical or electrical communications lines) or a medium implemented with wireless techniques (e.g., microwave, infrared or other transmission techniques). The series of computer instructions embodies all or part of the functionality previously described herein. Those skilled in the art should appreciate that such computer instructions can be written in a number of programming languages for use with many computer architectures or operating systems. Furthermore, such instructions may be stored in any memory device, such as semiconductor, magnetic, optical or other memory devices, and may be transmitted using any, communications technology, such as optical, infrared, microwave, or other transmission technologies. It is expected that such a computer program product may be distributed as a removable medium with accompanying printed or electronic documentation (e.g., shrink wrapped software), preloaded with a computer system (e.g., on system ROM or fixed disk), or distributed from a server over the network (e.g., the Internet or World Wide Web). Of course, some embodiments of the invention may be implemented as a combination of both software (e.g., a computer program product) and hardware. Still other embodiments of the invention may be implemented as entirely hardware, or entirely software (e.g., a computer program product).

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. An entertainment device comprising:

a fluid medium;

an electromagnetic frame disposed adjacent to the fluid medium, said frame having a plurality of sides and an electromagnetic coil at each side;

multiple mini-crafts, each simulating a miniaturized, propeller-driven vehicle including a propeller and being disposed within the sides of the frame, each said mini-craft comprising a magnet, each said mini-craft having a different cutoff frequency, said cutoff frequency being dependent on the shape and size of each said mini-craft and its corresponding magnet;

a controller in the form of a manual game controller for user control, said controller enabling entertainment of said user of said entertainment device wherein said controller provides a direct manual interface of said user with each said mini-craft so as to selectively move and maneuver each said mini-craft within said fluid medium through a variety of different kinds of landscapes, tunnels, obstacles, and target points;

a communication port adapted to receive multidirectional navigation signals from said controller;

a processor adapted to compute, based on the multidirectional navigation signals, electromagnetic signals for each coil in the electromagnetic frame, said processor being adapted to compute superimposed electromagnetic signals to separately control each said mini-craft based on its cutoff frequency; and rotating magnetic fields and gradients selectively formed by said electromagnetic signals acting upon the coils whereby the rotating magnetic fields and gradients cause the propeller of each said mini-craft to rotate and thereby maneuver each said mini-craft within the fluid medium and move in the directions indicated by the navigation signals.

2. The device of claim 1, wherein each said mini-craft maintains its position in the fluid medium when no electromagnetic force is applied thereon.

3. The device of claim 2, wherein each said mini-craft is substantially zero-buoyant with respect to the fluid contained in the fluid medium.

4. The device of claim 1, wherein the multidirectional navigation signals comprise motion commands to move each said mini-craft along at least one of the X, Y, and Z axis.

5. The device of claim 1, wherein the device is battery powered and portable.

6. The device of claim 1, wherein each said mini-craft is free of any electric circuitry or component other than the magnet.

7. An entertainment device comprising:

a fluid medium;

an electromagnetic frame disposed adjacent to the fluid medium, said frame having a plurality of sides and an electromagnetic coil at each side;

a plurality of mini-crafts each simulating an independently navigable miniaturized, propeller-driven vehicle including a propeller and being disposed within the sides of the frame, each mini-craft comprising a magnet and a different cutoff frequency;

a controller in the form of a manual game controller for user control, said controller enabling entertainment of said user of said entertainment device wherein said controller provides a direct manual interface of said user with each said mini-craft so as to selectively and independently move and maneuver each said mini-craft within said fluid medium through a variety of different kinds of landscapes, tunnels, obstacles, and target points;

a communication port adapted to receive multidirectional navigation signals from said controller;

a processor adapted to compute, based on the multidirectional navigation signals, electromagnetic signals for each coil in the electromagnetic frame; and superimposed rotating magnetic fields and gradients having different frequencies each corresponding to only given mini-craft and selectively formed by said electromagnetic signals acting upon the coils to cause the propeller of one or more corresponding mini-craft to rotate and thereby maneuver such one or more mini-craft; wherein each mini-craft operates in response to only one magnetic field based on its cutoff frequency.

8. The device of claim 7, wherein the mini-crafts maintain their position in the fluid medium when no electromagnetic force is applied thereon.

9. The device of claim 8, wherein the mini-crafts are substantially zero-buoyant with respect to the fluid contained in the fluid medium.

10. The device of claim 7, wherein the multidirectional navigation signals comprise motion commands to move the mini-craft along at least one of the X, Y, and Z axis.

11. The device of claim 7, wherein the cutoff frequency is dependent on the shape and size of the mini-craft and the magnet.

12. The device of claim 7, wherein the mini-craft is free of any electric circuitry or component other than the magnet.

13. An entertainment device comprising:

a fluid medium;

an electromagnetic frame disposed adjacent to the fluid medium, said frame having a plurality of sides and an electromagnetic coil at each side;

a mini-craft simulating a miniaturized, propeller-driven vehicle including a propeller and being disposed within the sides of the frame, said mini-craft comprising a magnet;

a controller in the form of a manual game controller for user control, said controller enabling entertainment of said user of said entertainment device wherein said controller provides a direct manual interface of said user with said mini-craft so as to selectively move and maneuver said mini-craft within said fluid medium;

a communication port adapted to receive multidirectional navigation signals from said controller;

a processor adapted to compute, based on the multidirectional navigation signals, electromagnetic signals for each coil in the electromagnetic frame; and rotating magnetic fields and gradients selectively formed by said electromagnetic signals acting upon the coils whereby the rotating magnetic fields and gradients cause the propeller of said mini-craft to rotate and thereby maneuver said mini-craft within the fluid medium and move in the directions indicated by the navigation signals.

14. The device of claim 13, wherein said mini-craft maintains its position in the fluid medium when no electromagnetic force is applied thereon.

15. The device of claim 13, wherein said mini-craft is substantially zero-buoyant with respect to the fluid contained in the fluid medium.

16. The device of claim 13, wherein said mini-craft is navigable within said fluid medium by said user through a variety of different kinds of landscapes, tunnels, obstacles, and target points.

17. The device of claim 13, wherein the magnet is located within the propeller of said mini-craft.

18. The device of claim 13, wherein the device is battery powered and portable.

19. The device of claim 13, wherein said mini-craft is free of any electric circuitry or component other than the magnet.

20. The device of claim 13, wherein the multidirectional navigation signals comprise motion commands to move said mini-craft along at least one of the X, Y, and Z axis.

* * * * *